US011110567B2

(12) United States Patent
Katayama

(10) Patent No.: US 11,110,567 B2
(45) Date of Patent: Sep. 7, 2021

(54) ANNULAR GRINDSTONE AND MANUFACTURING METHOD OF ANNULAR GRINDSTONE

(71) Applicant: DISCO CORPORATION, Tokyo (JP)

(72) Inventor: Soichi Katayama, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 222 days.

(21) Appl. No.: 16/258,071

(22) Filed: Jan. 25, 2019

(65) Prior Publication Data

US 2019/0240812 A1 Aug. 8, 2019

(30) Foreign Application Priority Data

Feb. 2, 2018 (JP) ..... JP2018-017074

(51) Int. Cl.
*B24D 18/00* (2006.01)

(52) U.S. Cl.
CPC ..... *B24D 18/0009* (2013.01); *B24D 18/0027* (2013.01); *B24D 18/0072* (2013.01); *B24D 2203/00* (2013.01)

(58) Field of Classification Search
CPC ..... B24D 18/0009; B24D 18/0027; B24D 18/0072; B24D 2203/00
See application file for complete search history.

(56) References Cited

U.S. PATENT DOCUMENTS 3,641,718 A * 2/1972 Ferchland ..... B24D 18/00 451/488
3,694,325 A * 9/1972 Katz ..... C25D 17/04 205/75
3,813,230 A * 5/1974 Ferchland ..... B24D 5/12 51/297
4,401,442 A * 8/1983 Oide ..... B24D 18/00 51/297
6,319,109 B1 * 11/2001 Fujii ..... B24D 3/08 51/295
6,485,533 B1 * 11/2002 Ishizaki ..... B24D 3/10 51/293

FOREIGN PATENT DOCUMENTS

JP 2000087282 A 3/2000
JP 2016168655 A 9/2016
WO WO-9928087 A1 * 6/1999 ..... B24D 18/0009

* cited by examiner

*Primary Examiner* — Pegah Parvini
*Assistant Examiner* — Ross J Christie
(74) *Attorney, Agent, or Firm* — Greer Burns & Crain Ltd.

(57) ABSTRACT

An annular grindstone includes a grindstone portion in which abrasive grains are fixed with a bonding material containing nickel and has a through hole at the center thereof. The grindstone portion has a laminated structure of a total of three or more layers in which a first layer and a second layer having a porous structure are alternately laminated on top of another along a penetrating direction of the through hole and both of outermost layers in the laminated structure which are exposed outside are the first layers.

6 Claims, 6 Drawing Sheets

ANNULAR GRINDSTONE AND MANUFACTURING METHOD OF ANNULAR GRINDSTONE

BACKGROUND OF THE INVENTION

Field of the Invention

The present invention relates to an annular grindstone mounted to a cutting apparatus and a manufacturing method of the annular grindstone.

Description of the Related Art

Device chips are, for example, formed by cutting a disc-shaped wafer containing a semiconductor. For example, a plurality of crossing division lines are set on a front surface of the wafer to be demarcated in a plurality of regions, and each of the regions thus demarcated by the division lines has devices such as an integrated circuit (IC) formed therein. Then, the wafer is divided along the division lines into individual device chips. In recent years, along with miniaturization and thinning of electronic equipment, demands for miniaturization and thinning of a device chip mounted in the electronic equipment has also increased. A thin device chip is formed by, for example, forming a plurality of devices on a front surface of a wafer, then grinding a back surface of the wafer to thin the wafer to a predetermined thickness, and thereafter, dividing the wafer along division lines.

Dividing the wafer is conducted by using a cutting apparatus provided with an annular grindstone (cutting blade). In the cutting apparatus, the annular grindstone is rotated in a plane perpendicular to a workpiece such as a wafer to cut in the workpiece. The annular grindstone includes abrasive grains and a bonding material in which the abrasive grains are dispersed, and the abrasive grains which are moderately exposed from the bonding material comes in contact with the workpiece, whereby the workpiece is cut (see Japanese Patent Laid-Open No. 2000-87282, for example). When cutting processing of the workpiece proceeds, the abrasive grains fall off from the bonding material, and accordingly, a blade edge is worn. As a result, fresh abrasive grains are exposed from the bonding material one after another. This effect is referred to as self-sharpening, and the self-sharpening effect keeps cutting performance of the annular grindstone at a constant level or more.

Meanwhile, an optical device such as a light emitting diode (LED) adopts a sapphire substrate which is excellent in mechanical and thermal properties and is chemically stable. A plurality of optical devices are formed in the sapphire substrate, and the sapphire substrate is divided into each optical device, thereby forming optical device chips. However, the sapphire substrate is a material which is extremely high in hardness and referred to as a difficult-to-cut material. For cutting a difficult-to-cut material, for example, an annular grindstone, called a hub type, having an outer peripheral edge of an annular base to which a grindstone portion is electrodeposited by electrolytic plating or the like method is used. More specifically, the annular grindstone is formed by electrodepositing a bonding material such as a nickel layer in which abrasive grains such as diamond grains or the like are dispersed, to an aluminum base. Note that the annular grindstone formed by electrolytic plating is referred to as an electrodeposited grindstone. Since, in an electrodeposited grindstone having a nickel layer as a bonding material, abrasive grains are strongly fixed to the bonding material, self-sharpening is less likely to occur in the electrodeposited grindstone, which causes a problem that the cutting performance of the grindstone cannot be maintained at a sufficient level. Thus, in order to easily make the self-sharpening effect occur, an annular grindstone provided with a bonding material having a porous structure has been developed (see Japanese Patent Laid-Open No. 2016-168655, for example).

SUMMARY OF THE INVENTION

When a workpiece is cut with the annular grindstone having a bonding material of a porous structure, the bonding material is consumed, and the self-sharpening occurs moderately, thereby keeping the cutting performance of the annular grindstone at a constant level or more. However, since a side surface of the annular grindstone is also liable to be worn, a strength of the annular grindstone is low.

It is therefore an object of the present invention to provide an annular grindstone having a porous structure and being likely to easily generate self-sharpening can be suppressed to thereby prevent a strength of the annular grindstone from being lowered, and a manufacturing method of the annular grindstone.

In accordance with an aspect of the present invention, there is provided an annular grindstone which includes a grindstone portion in which abrasive grains are fixed with a bonding material containing nickel and has a through hole at a center thereof, in which the grindstone portion has a laminated structure of a total of three or more layers in which a first layer and a second layer having a porous structure are alternately laminated on top of another in a penetrating direction of the through hole and both of outermost layers in the laminated structure which are exposed outside are the first layers.

Preferably, the first layer may have a porous structure including a pore having a smaller diameter than a diameter of a pore included in a porous structure of the second layer. Alternatively, the first layer may have no porous structure.

More preferably, the annular grindstone may be formed only of the grindstone portion. Alternatively, the annular grindstone may further include an annular base, and the grindstone portion may be disposed at an outer periphery edge of the annular base.

According to another aspect of the present invention, a manufacturing method of an annular grindstone which includes a grindstone portion in which abrasive grains are fixed with a bonding material containing nickel and has a through hole at the center thereof. The manufacturing method includes a plating bath preparation step of preparing a plating bath in which a nickel plating solution into which the abrasive grains are mixed and an additive which contributes to formation of a porous structure are stored, an immersion step of immersing a base and a nickel electrode in the plating bath, a grindstone portion forming step of flowing a direct current through the plating solution with the base as a cathode and the nickel electrode as an anode, thereby depositing a plating layer containing the abrasive grains on a front surface of the base to form the grindstone portion, and a base removing step of removing all or part of the base to expose all or part of a region of the grindstone portion which is covered with the base. In this method, in the grindstone portion forming step, a first layer and a second layer having a porous structure are caused to be alternately laminated on top of another by alternately changing a current density of the direct current between a current density smaller than a predetermined value and a current density of the predetermined value or more, thereby forming the grindstone portion having a laminated structure of a total of three or more layers in which both of outermost layers which are exposed outside are the first layers.

The annular grindstone according to one aspect of the present invention includes the grindstone portion having the laminated structure of a total of three or more layers in which the first layer and the second layer having the porous structure are alternately laminated on top of another in a penetrating direction of the through hole, and both of the outermost layers in the laminated structure which are exposed outside are the first layers. Since the annular grindstone according to one aspect of the present invention includes the second layer having the porous structure, compared to an annular grindstone not including the second layer having the porous structure, the grindstone portion is liable to be worn, whereby self-sharpening due to the wear is likely to occur. On the other hand, since the annular grindstone according to one aspect of the present invention includes the first layer, the annular grindstone is high in strength compared to an annular grindstone including a grindstone portion formed only with the second layer having the porous structure. Further, since both of the outermost layers in the laminated structure which are exposed outside are the first layers, a side surface of the annular grindstone is less likely to be worn.

Thus, according to one aspect of the present invention, an annular grindstone having a porous structure and being likely to easily generate self-sharpening can be suppressed to thereby prevent a strength of the annular grindstone from being lowered, and a manufacturing method of the annular grindstone are provided.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1A:
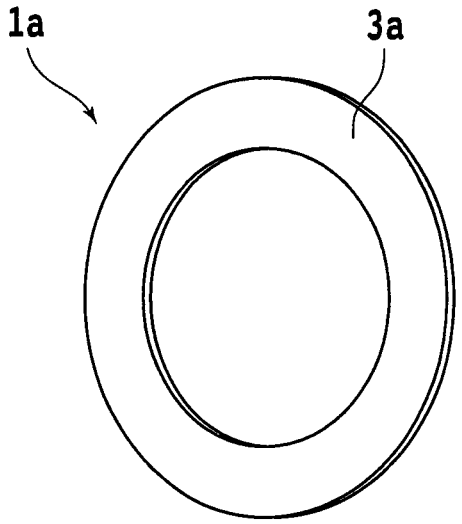
FIG. 1A is a perspective view schematically illustrating an annular grindstone including a grindstone portion.

An embodiment of the present invention will be described below. FIG. 1A is a perspective view schematically illustrating an annular grindstone including a grindstone portion, as one example of an annular grindstone (cutting blade) according to the present embodiment. An annular grindstone 1*a* illustrated in FIG. 1A is a grindstone called a washer type.

Figure 1B:
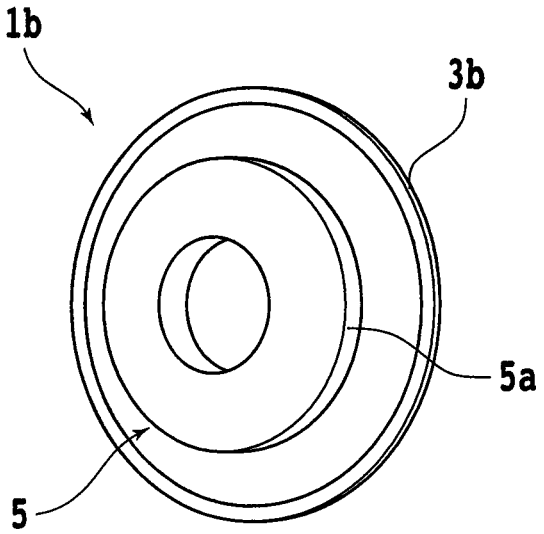
FIG. 1B is a perspective view schematically illustrating an annular grindstone including an annular base and a grindstone portion.

The annular grindstone 1*a* includes a grindstone portion 3*a* of a circular ring-shape having a through hole at the center thereof. The annular grindstone 1*a* is mounted on a cutting unit of a cutting apparatus. The through hole has a spindle passing therethrough, and by rotating the spindle, the annular grindstone 1*a* is rotated in a plane perpendicular to an extending direction of the through hole. Then, when the grindstone portion 3*a* of the rotating annular grindstone 1*a* is brought into contact with a workpiece, the workpiece is cut. Note that the annular grindstone according to the present embodiment is not limited to this. FIG. 1B is a perspective view schematically illustrating an annular grindstone including an annular base and a grindstone portion. An annular grindstone 1*b* illustrated in FIG. 1B is a grindstone, called a hub type, in which a grindstone portion 3*b* is disposed at an outer periphery edge of an annular base 5. The annular base 5 has a grip portion 5*a* held by a user (operator) of the cutting apparatus when attaching/detaching the annular grindstone 1*b* to/from the cutting unit of the cutting apparatus.

The grindstone portions 3*a* and 3*b* are each formed, for example, by electrodepositing a bonding material such as a nickel layer in which abrasive grains such as diamond abrasive grains are dispersed, to a base. Note that the annular grindstones 1*a* and 1*b* formed by electrolytic plating or the like method are also referred to as electrodeposited grindstones. The grindstone portions 3*a* and 3*b* of the annular grindstones 1*a* and 1*b* each contain a bonding material and abrasive grains (see FIG. 2A and FIG. 2B) which are dispersed in the bonding material and fixed thereto. The abrasive grains which are moderately exposed from the bonding material come in contact with the workpiece, whereby the workpiece is cut. When cutting of the workpiece proceeds, the abrasive grains fall off from the bonding material. At this time, a blade edge is worn out, and as a result, fresh abrasive grains are exposed from the bonding material one after another. This effect is referred to as self-sharpening, and this self-sharpening effect keeps the cutting performance of each of the annular grindstones 1*a* and 1*b* at a constant level or more.

The workpiece is a substantially disc-shaped substrate or the like composed of a material such as silicon or silicon carbide (SiC), or other semiconductor materials, or a material composed of sapphire, glass, quartz, or the like. For example, a front surface of the workpiece is demarcated by a plurality of division lines arrayed in a grid pattern into a plurality of regions, and each of the regions thus demarcated has a device such as an IC or an LED formed therein. In the last step, the workpiece is divided along the division lines and formed into individual device chips.

Note that, since the abrasive grains are strongly fixed to the bonding material in the electrodeposited grindstone having the nickel layer as the bonding material, self-sharpening is less likely to occur in the electrodeposited grindstone, and the cutting performance of the grindstone is hard to maintain sufficiently. In contrast, when the workpiece is cut with a grindstone including a bonding material having a porous structure in which self-sharpening effect easily occurs, a side surface of the grindstone is easily worn, and as a result, strength of the grindstone lowers. In view of this, the annular grindstones 1*a* and 1*b* according to the present embodiment including the grindstone portions 3*a* and 3*b*, respectively, in which a first layer and a second layer which are different in structure from each other are alternately laminated on top of another, are used. A structure of the grindstone portion will be described below by taking the annular grindstone 1*a* of washer type as an example.

Figure 2A:
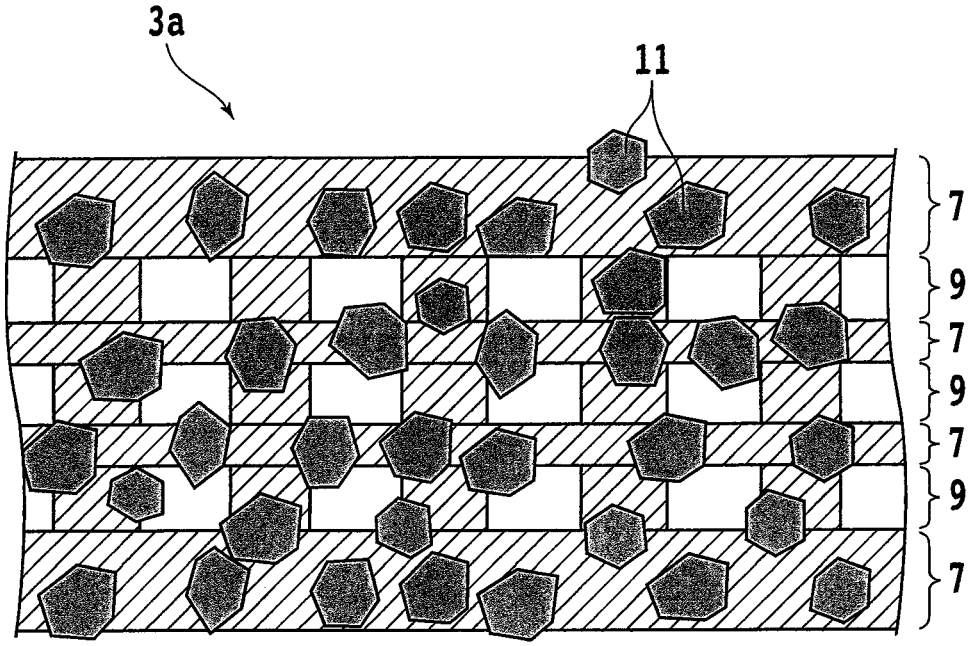
FIG. 2A is a cross-sectional view schematically illustrating the grindstone portion.
Figure 2B:
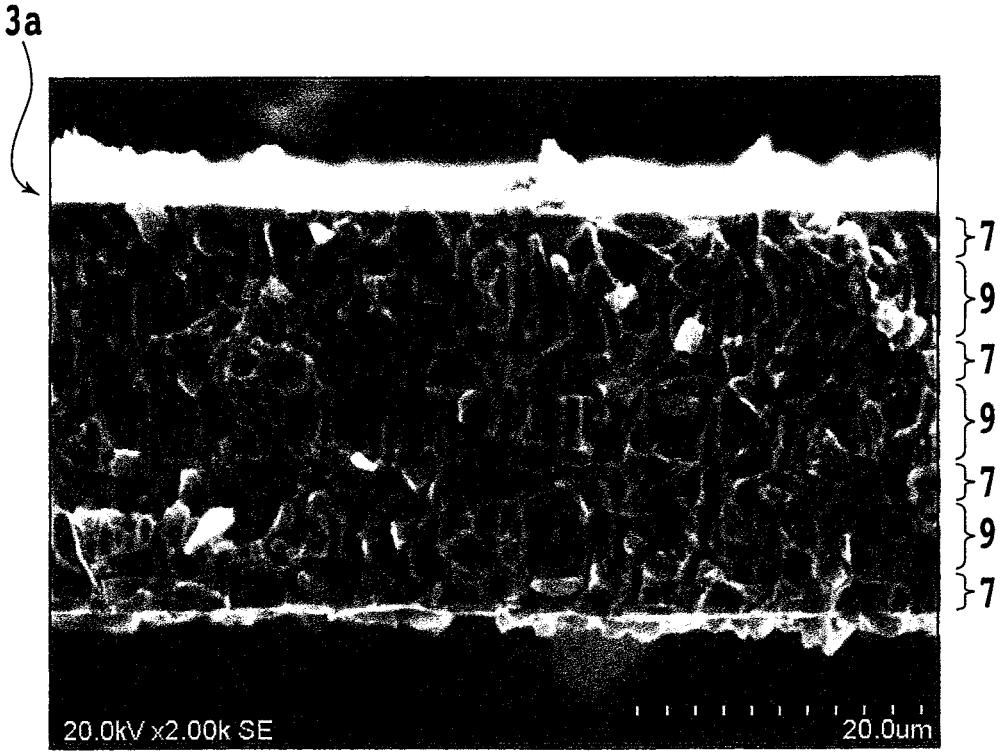
FIG. 2B is a cross-sectional photograph of one example of the grindstone portion.

FIG. 2A is a cross-sectional view schematically illustrating the grindstone portion 3*a*. FIG. 2B is a cross-sectional photograph of the grindstone portion 3*a* of the annular grindstone 1*a* which has actually been fabricated. Note that the cross-sectional photograph is imaged by a scanning electron microscope (SEM). As illustrated in FIG. 2A and FIG. 2B, the bonding material of the grindstone portion 3*a* includes a laminated structure of a total of three or more layers in which a first layer 7 and a second layer 9 are alternately laminated on top of another, and both of outermost layers in the laminated structure which are exposed outside are the first layers 7.

In this case, the first layer 7 has a porous structure including a pore having a smaller diameter than a diameter of a pore included in a porous structure of the second layer 9. Alternatively, the first layer 7 may have no porous structure. The first layer 7 having such a structure becomes a layer having high strength and which is less likely to be worn, compared to the second layer 9. Note that, in a case in which the first layer 7 has the porous structure, a magnitude relation in diameter between a pore included in the porous structure of the first layer 7 and a pore included in the porous structure of the second layer 9 can be evaluated by comparing an average diameter of a plurality of pores included in each of the porous structures with each other. Alternatively, it is derived from a photograph imaged by the SEM. More alternatively, it may be evaluated by another method.

The annular grindstone 1*a* includes the second layer 9 having the porous structure. Accordingly, comparing the annular grindstone 1*a* with an annular grindstone not including the second layer 9 having the porous structure, self-sharpening due to wear is likely to occur in the annular grindstone 1*a*. Abrasive grains 11 are dispersed in the bonding material constituting the grindstone portion 3*a*. Even in a case in which the annular grindstone 1*a* is used to cut a difficult-to-cut material, the grindstone portion 3*a* is moderately consumed, and fresh abrasive grains 11 are exposed one after another, so that the cutting performance of the annular grindstone 1*a* is sufficiently maintained. On the other hand, since the annular grindstone 1*a* includes the first layer 7, strength of the annular grindstone 1*a* becomes high, comparing the annular grindstone 1*a* with an annular grindstone provided with a grindstone portion including only the second layer 9. Further, the outermost layers of the grindstone portion 3*a* are the first layers 7 which are high in strength, and accordingly, a side surface of the annular grindstone 1*a* is less likely to be worn.

Figure 3:
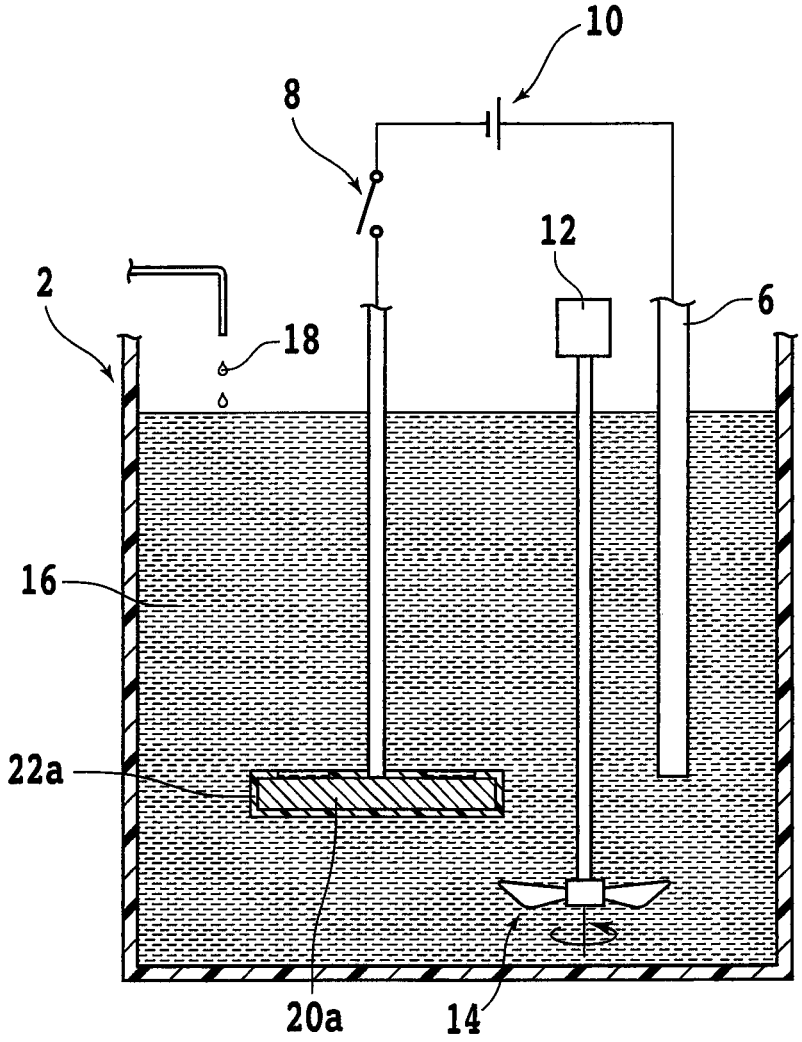
FIG. 3 is a cross-sectional view schematically illustrating a manufacturing process of the annular grindstone including the grindstone portion illustrated in FIG. 1A.

Next, a manufacturing method of the annular grindstone 1*a* of washer type illustrated in FIG. 1A will be described below. FIG. 3 is a cross-sectional view schematically illustrating a manufacturing process of the annular grindstone 1*a* including the grindstone portion only. The annular grindstone 1*a* is formed by, for example, electrolytic plating or the like method. In the manufacturing method, first, carried out is a plating bath preparation step of preparing a plating bath 2 in which a nickel plating solution 16 into which abrasive grains are mixed and an additive 18 which contributes to formation of a plating layer including a layer having a porous structure are stored. The nickel plating solution 16 is an electrolytic solution containing nickel (ion) such as nickel sulfate or nickel nitrate, and mixed with abrasive grains such as diamond. Note that 6 L of the nickel plating solution 16 (Watts bath) containing 270 g/L of nickel sulfate, 45 g/L of nickel chloride, and 40 g/L of boric acid is used in the present embodiment. However, a configuration and a use quantity of the nickel plating solution 16 can be arbitrarily set. This nickel plating solution 16 is further added with the additive 18 for rendering the annular grindstone 1*a* more porous as illustrated in FIG. 3. Preferably, the additive 18 to be used here includes a water-soluble ammonium compound having a hydrophobic group such as an alkyl group, an aryl group, and an aralkyl group.

Examples of the alkyl group may include a linear or branched alkyl group having 1 to 20 carbon atoms, such as a methyl group, an ethyl group, an n-propyl group, an isopropyl group, an n-butyl group, an isobutyl group, a sec-butyl group, a tert-butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, and an octadecyl group. Examples of the aryl group may include a phenyl group, a naphthyl group, and the like. In addition, the aryl group may be bonded with substituents such as halogen atoms such as a fluorine atom and a chlorine atom, the alkyl group such as a methyl group and an ethyl group, a haloalkyl group such as a trifluoromethyl group, an alkoxy group such as a methoxy group and an ethoxy group, and an aryl group such as a phenyl group. Examples of the aralkyl group may include an aralkyl group having 7 to 10 carbon atoms, such as a 2-phenylethyl group, a benzyl group, 1-phenylethyl group, 3-phenylpropyl group, and 4-phenylbutyl group. The aralkyl group may be bonded with the substituents similar to those bonded to the aryl group described above.

Examples of the ammonium compound may include dodecyltrimethylammonium chloride, tetradecyltrimethylammonium chloride, hexadecyltrimethylammonium chloride, octadecyltrimethylammonium chloride, phenyltrimethylammonium chloride, benzyltrimethylammonium chloride, benzyltriethylammonium chloride, benzyltributylammonium chloride, didecyldimethylammonium chloride, dodecyldimethylbenzylammonium chloride, tetradecyldimethylbenzylammonium chloride, octadecyldimethylbenzylammonium chloride, trioctylmethylammonium chloride, dodecylpyridinium chloride, benzylpyridinium chloride, bromides thereof, sulfate salts thereof, and the like. Note that these ammonium compounds may be used independently or in combination of two or more.

In the present embodiment, "top porous nickel RSN" manufactured by Okuno Chemical Industries Co., Ltd. is used as the additive 18, and is added such that a quantity of "top porous nickel RSN" relative to the nickel plating solution 16 is 1 mL/L or more and 10 mL/L or less.

After the plating bath preparation step is carried out, an immersion step is carried out in which a base 20*a* on which the grindstone portion 3*a* is formed through electrodeposition, and a nickel electrode 6 are immersed into the nickel plating solution 16 in the plating bath 2. The base 20*a* is, for example, formed of a metal material such as stainless or aluminum in a disc-like shape, and on a front surface thereof, a mask 22*a* corresponding to a desired shape of the grindstone portion 3*a* is formed. Note that the mask 22*a* which achieves a circular ring-shaped grindstone 1*a* is formed in the present embodiment. The base 20*a* is connected to a minus terminal (negative electrode) of a direct-current (DC) power source 10 through a switch 8. Meanwhile, the nickel electrode 6 is connected to a plus terminal (positive electrode) of the DC power source 10. Note that the switch 8 may be disposed between the nickel electrode 6 and the DC power source 10.

Figure 4A:
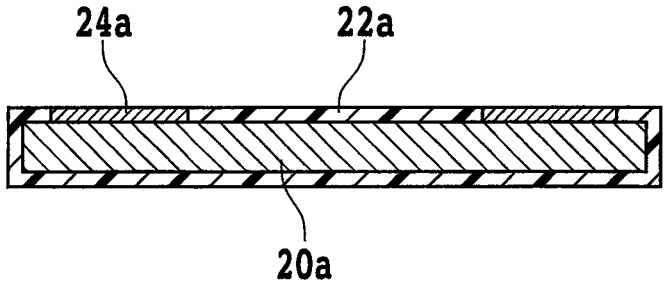
FIG. 4A is a cross-sectional view schematically illustrating a grindstone portion forming step in the manufacturing process illustrated in FIG. 3.

After the immersion step is carried out, a grindstone portion forming step is carried out in which, by causing a direct current to flow through the nickel plating solution 16 with the base 20*a* as a cathode and the nickel electrode 6 as an anode, abrasive grains and a plating layer are deposited on a portion of the front surface of the base 20*a* which is not covered with the mask 22*a* to form the grindstone portion 3*a*. FIG. 4A is a cross-sectional view schematically illustrating a grindstone portion forming step. Specifically, as illustrated in FIG. 3, while a fan 14 is rotated by a rotation driving source 12 such as an electric motor to stir the nickel plating solution 16, the switch 8 disposed between the base 20*a* and the DC power source 10 is short-circuited. Accordingly, as illustrated in FIG. 4A, the grindstone portion 3*a* (plating layer 24*a*) in which the abrasive grains are substantially equally dispersed in the plating layer containing nickel can be formed. When the grindstone portion 3*a* (plating layer 24*a*) with a desired thickness is obtained, the grindstone portion forming step is ended.

Note that, in the grindstone portion forming step, a current density of the DC power source 10 is alternately changed between a current density of smaller than a predetermined value and a current density of the predetermined value or more. In this case, the current density is a current value per unit area, and more specifically, a current value of the direct current relative to an area in which the plating layer 24*a* is formed (an area of the base 20*a* which is exposed from the mask 22*a*). In forming the plating layer 24*a* containing nickel, when the direct current is caused to flow at a relatively high current density, a layer having a porous structure in which a pore is large in diameter is likely to be formed. In addition, the diameter of the pore in the porous structure in the plating layer 24*a* to be formed tends to be smaller as the current density becomes lower, and when the direct current is caused to flow at a much lower current density, the structure becomes less porous, which cannot be considered as the porous structure.

In view of this, in the grindstone portion forming step, the direct current is caused to flow by alternately changing between a current density of smaller than a predetermined value and a current density of the predetermined value or more, whereby the first layer 7 which is high in strength, and the second layer 9 having the porous structure are alternately laminated on top of another. In this case, the predetermined value of the current density is a value appropriately set in accordance with a mixed ratio of each component contained in the nickel plating solution 16, a structure of the grindstone portion 3*a* to be formed, or the like. Note that, in order to make both of the outermost layers in the laminated structure which are exposed outside the annular grindstone 1*a* the first layers 7 which are high in strength, the DC power source 10 is controlled such that the direct current becomes the current density smaller than the predetermined value when the direct current starts flowing through the plating bath 2 and the flowing of the direct current ends.

Figure 4B:
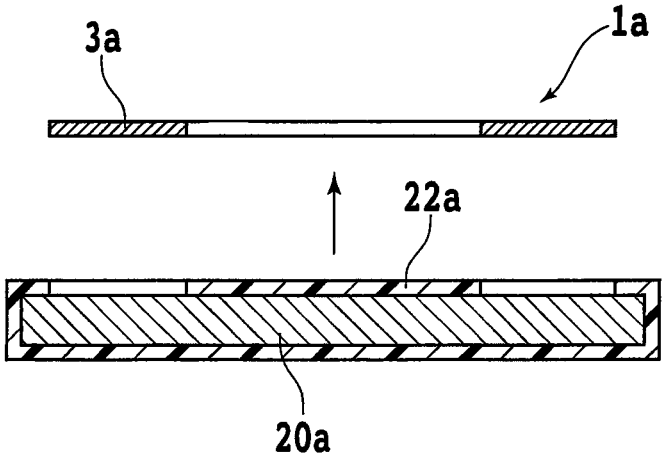
FIG. 4B is a cross-sectional view schematically illustrating a base removing step in the manufacturing process illustrated in FIG. 3.

Next, a base removing step is carried out in which all or part of the base 20*a* is removed to expose all or part of a region of the grindstone portion 3*a* (plating layer 24*a*) which is covered with the base 20*a*. FIG. 4B is a cross-sectional view schematically illustrating the base removing step. In an example illustrated in FIG. 4B, the grindstone portion 3*a* is separated from the base 20*a* to thereby remove the whole base 20*a* from the grindstone portion 3*a*. Accordingly, the annular grindstone 1*a* of washer type is achieved. A cross-sectional photograph shown in FIG. 2B is an SEM image obtained by imaging a cross-section of the grindstone portion 3*a* of the annular grindstone 1*a* manufactured by the present manufacturing method.

Note that the present invention is not limited to the description of the above-described embodiment and can be implemented in various modifications. For example, in the above-described embodiment, a manufacturing method of the annular grindstone 1*a* of washer type has been described; however, the present invention is not limited to this. According to the manufacturing method, the annular grindstone 1*b* of hub type can also be manufactured, for example.

Figure 5:
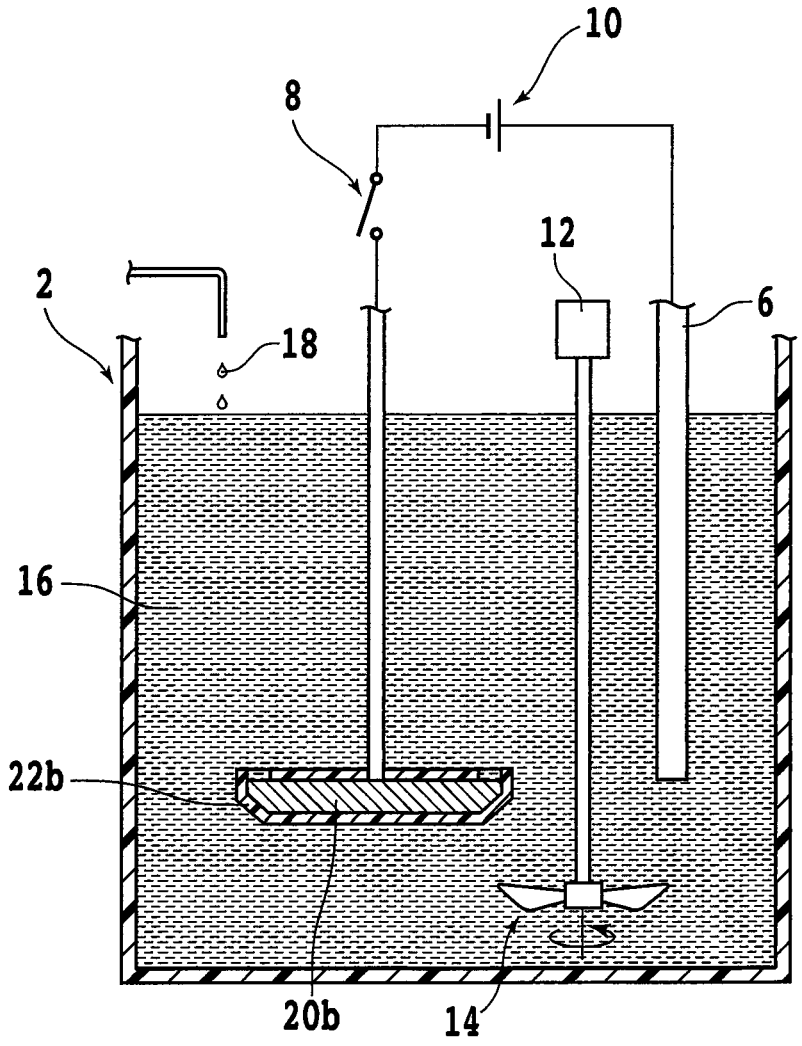
FIG. 5 is a cross-sectional view schematically illustrating a manufacturing process of the annular grindstone including the grindstone portion and the annular base illustrated in FIG. 1B.

A manufacturing method of the annular grindstone 1*b* of hub type will be described herein below. FIG. 5 is a cross-sectional view schematically illustrating a manufacturing process of the annular grindstone 1*b* including the grindstone portion and the annular base illustrated in FIG. 1B. Similarly to the annular grindstone 1*a*, the annular grindstone 1*b* is formed by a method such as electrolytic plating in the plating bath 2, for example. In the manufacturing method, the plating bath preparation step is carried out similarly to the manufacturing method of the annular grindstone 1*a*. Since a configuration of the plating bath 2, the nickel plating solution 16, and the additive 18 is similar to one in the above-described manufacturing method of the annular grindstone 1*a*, description thereof will be omitted here. However, part of the base 20*b* connected to the negative electrode of the DC power source 10 becomes the annular base 5 (see FIG. 1B) supporting the grindstone portion 3*b* of the annular grindstone 1*b*, a shape of the base 20*b* is assumed to be a shape corresponding to the annular base 5. In addition, on a front surface of the base 20*b*, a mask 22*b* in a shape corresponding to the shape of the grindstone portion 3*b* is formed. Then, in the similar manner to the manufacturing method of the annular grindstone 1*a* described above, the immersion step and the grindstone portion forming step are carried out.

Figure 6A:
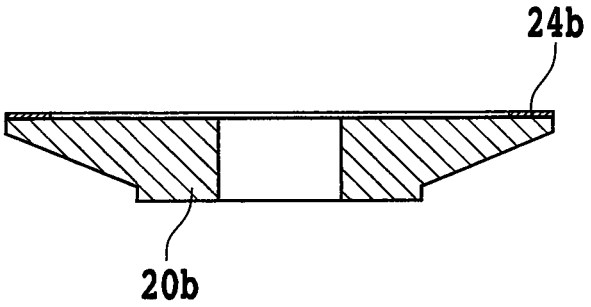
FIG. 6A is a cross-sectional view schematically illustrating a grindstone portion forming step in the manufacturing process illustrated in FIG. 5.
Figure 6B:
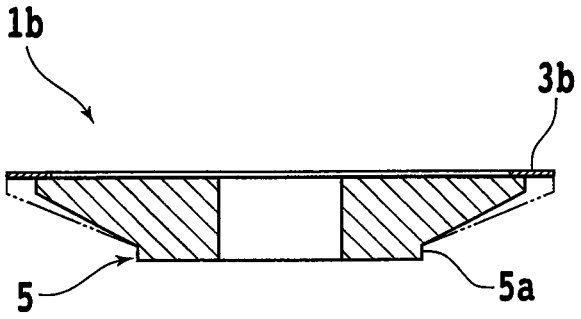
FIG. 6B is a cross-sectional view schematically illustrating a base removing step in the manufacturing process illustrated in FIG. 5.

Next, a base removing step is carried out in which part of the base 20*b* is removed to expose part of a region of the grindstone portion 3*b* (plating layer 24*a*, see FIG. 6A) which is covered with the base 20*b*. Note that, as illustrated in FIG. 6A, the mask 22*b* is removed from the base 20*b* in advance before the base removing step is carried out. Then, as illustrated in FIG. 6B, an outer peripheral region of the base 20*b* on a side with the grindstone portion 3*b* not formed is partially etched to thereby expose the part of the grindstone portion 3*b* which is covered with the base 20*b*. Accordingly, the annular grindstone 1*b* of hub type in which the grindstone portion 3*b* is fixed to an outer peripheral region of the annular base 5 is achieved. Note that the grip portion 5*a* may be formed on the annular base 5 by the etching and alternatively, may be formed on the base 20*b* in advance.

In addition, in the above embodiment, there has been described a case in which the first layer 7 having a high strength is formed by setting the current density of the direct current at a current density smaller than a predetermined value and the second layer 9 having the porous structure is formed by setting the current density of the direct current at the predetermined value or more; however, one aspect of the present invention is not limited to this. Depending on the mixed ratio of each component contained in the nickel plating solution 16, the structure of the grindstone portion 3*a* to be formed, or the like, the first layer 7 having a high strength may be formed by setting the current density of the direct current at the predetermined value or more, and the second layer 9 having the porous structure may be formed by setting the current density of the direct current at a current density smaller than the predetermined value.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. An annular grindstone, comprising:

a grindstone portion in which abrasive grains are fixed with a bonding material containing nickel, wherein the grindstone portion has a laminated structure of a total of three or more layers in which a first layer having a porous structure with a first pore size and a second layer having a porous structure with a second pore size different from the first pore size are alternately laminated on top of another in a penetrating direction of a through hole and both of outermost layers in the laminated structure which are exposed outside are the first layers.

2. The annular grindstone according to claim 1, wherein the first pore size of first layer has a a smaller diameter than a diameter of the second pore size of the second layer.

3. The annular grindstone according to claim 1, wherein the annular grindstone is formed only of the grindstone portion.

4. The annular grindstone according to claim 1, further comprising:

an annular base, wherein the grindstone portion is disposed at an outer periphery edge of the annular base.

5. A manufacturing method of an annular grindstone which includes a grindstone portion in which abrasive grains are fixed with a bonding material containing nickel and has a through hole at a center thereof, the manufacturing method comprising:

a plating bath preparation step of preparing a plating bath in which a nickel plating solution into which the abrasive grains are mixed and an additive which contributes to formation of a porous structure are stored;

an immersion step of immersing a base and a nickel electrode in the plating bath;

a grindstone portion forming step of flowing a direct current through the plating solution with the base as a cathode and the nickel electrode as an anode, thereby depositing a plating layer containing the abrasive grains on a front surface of the base to form the grindstone portion; and a base removing step of removing all or part of the base to expose all or part of a region of the grindstone portion which is covered with the base, wherein, in the grindstone portion forming step, a first layer having a porous structure with a first pore size and a second layer having a porous structure with a second pore size different from the first pore size are caused to be alternately laminated on top of another by alternately changing a current density of the direct current between a current density smaller than a predetermined value and a current density of the predetermined value or more, thereby forming the grindstone portion having a laminated structure of a total of three or more layers in which both of outermost layers which are exposed outside are the first layers.

6. An annular grindstone, comprising:

a grindstone portion in which abrasive grains are fixed with a bonding material containing nickel; and a through hole at a center of the grindstone portion, wherein the grindstone portion has a laminated structure of a total of three or more layers in which a first layer having a non-porous structure and a second layer having a porous structure, are alternately laminated on top of another in a penetrating direction of the through hole and both of outermost layers in the laminated structure which are exposed outside are the first layers.

* * * * *